US010051372B2

(12) United States Patent
Zamir

(10) Patent No.: US 10,051,372 B2
(45) Date of Patent: Aug. 14, 2018

(54) HEADSET ENABLING EXTRAORDINARY HEARING

(71) Applicant: BOSE CORPORATION, Framingham, MA (US)

(72) Inventor: Lee Zamir, Cambridge, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/086,854

(22) Filed: Mar. 31, 2016

(65) Prior Publication Data

US 2017/0289687 A1 Oct. 5, 2017

(51) Int. Cl.

| | |
|---|---|
| ***H04R 3/02*** | (2006.01) |
| ***H04R 5/04*** | (2006.01) |
| ***G10L 21/14*** | (2013.01) |
| ***H04R 3/12*** | (2006.01) |
| ***H04R 5/033*** | (2006.01) |

(52) U.S. Cl.
CPC ..... *H04R 5/04* (2013.01); *G10L 21/14* (2013.01); *H04R 3/12* (2013.01); *H04R 5/033* (2013.01); *H04R 2430/03* (2013.01)

(58) Field of Classification Search
CPC ..... H04R 5/04; H04R 5/033; H04R 21/14; H04R 3/12; H04R 2430/03
USPC ..... 381/74, 61
See application file for complete search history.

(56) References Cited

U.S. PATENT DOCUMENTS 4,629,834 A 12/1986 Waggoner et al.
5,047,994 A * 9/1991 Lenhardt ..... H04R 25/606 367/116
8,913,753 B2 * 12/2014 Cohen ..... H04S 1/00 381/56
2006/0147068 A1 * 7/2006 Aarts ..... A61B 5/02438 381/309
2010/0290636 A1 * 11/2010 Mao ..... H04S 7/304 381/74
2011/0228948 A1 9/2011 Engel
2012/0230507 A1 * 9/2012 DeLuca ..... H04R 1/1041 381/74
2012/0328119 A1 * 12/2012 Heise ..... H04R 1/1066 381/74

(Continued)

FOREIGN PATENT DOCUMENTS

WO 2012041372 A1 4/2012

OTHER PUBLICATIONS

Invitation to Pay Additional Fees and Partial International Search Report dated Apr. 28, 2017 for PCT/US2017/016528.

(Continued)

*Primary Examiner* — Disler Paul
(74) *Attorney, Agent, or Firm* — Patterson + Sheridan, LLP

(57) ABSTRACT

An apparatus includes a headphone driver and a processor in communication with the headphone driver. The processor is configured to receive an audio setting selection from among a plurality of audio setting selections. Each audio setting selection is associated with a frequency range that includes at least one frequency that is outside of a range of human hearing. The processor is further configured to receive an audio signal and to process the audio signal according to the selected audio setting selection to generate an output signal. The processor is configured to provide an output signal to the headphone driver.

13 Claims, 3 Drawing Sheets

(56) References Cited

U.S. PATENT DOCUMENTS

| | | | | |
|---|---|---|---|---|
| 2014/0247951 | A1* | 9/2014 | Malaviya | H04R 1/105<br>381/74 |
| 2015/0015361 | A1* | 1/2015 | Sceery | G06Q 40/00<br>340/4.42 |
| 2015/0016632 | A1 | 1/2015 | Hillis et al. | |
| 2015/0117661 | A1* | 4/2015 | Kulavik | H04R 1/1041<br>381/74 |

OTHER PUBLICATIONS

International Search Report for Application No. PCT/US2017/016528, dated Jun. 26, 2017.

* cited by examiner

HEADSET ENABLING EXTRAORDINARY HEARING

I. FIELD OF THE DISCLOSURE

The present disclosure relates in general to a hearing device, and more particularly, to a headset that extends or otherwise manipulates hearing capabilities to better appreciate headphone technology and audio dynamics.

II. BACKGROUND

Learning about hearing promotes healthy listening habits, curiosity, and innovations in understanding the human ear and the effects of noise. School programs and literature and public service promotions, as well as warning signs and labels help promote ear safety and education. However, persistent naivety and misunderstandings about the limitations of the ear lead to dangerous exposure to harmful noise and unnecessary hearing loss.

III. SUMMARY

All examples and features mentioned below can be combined in any technically possible way.

In one aspect, an apparatus includes a headphone driver and a processor in communication with the headphone driver, where the processor is configured to receive an audio setting selection from among a plurality of audio setting selections, where each audio setting selection is associated with a frequency range that is outside of a range of human hearing. The processor is configured to receive an audio signal and to process the audio signal according to the selected audio setting selection to generate an output signal. The processor is further configured to provide the output signal to the headphone driver.

A microphone of an example is configured to capture an audio input and to generate the audio signal. Processing the audio signal includes shifting a portion of the audio signal that is outside of the range of human hearing into the range of human hearing. The processor is configured to receive user input affecting the processing of the audio signal from an application executing on a remote electronic device. The processor is configured to initiate a display of audio related information associated with the output signal.

According to an implementation, the audio signal (or the audio input) includes at least one of environmental sound detected by a microphone and audio relayed from an electronic device having a memory. The audio setting selection corresponds to at least one of a range of frequencies below 20 Hertz (Hz) and a range of frequencies above 20 kilohertz (kHz). The audio setting selection, in an example, corresponds to a range of hearing of a non-human species of animal. The headset includes one or more shared ports.

According to another particular implementation, the processor is configured to display one or more waveforms associated with the processed sound. According to another particular implementation, the processor initiates playback of a recording that demonstrates sound heard by a person with a hearing loss on a particular frequency range.

In an example, an apparatus includes a headphone driver and a processor in communication with the headphone driver. The processor is configured to receive user input corresponding to a frequency range associated with a level of diminished hearing. The apparatus receives an audio signal and processes the audio signal according to the level of diminished hearing to generate an output signal. The output signal is output to the headphone driver.

The level of diminished hearing simulates a frequency range associated with a loss of hearing attributable to aging or loud noise. The user input is further configured to initiate sending an undiminished audio signal to the headphone driver. The user input selectively causes switching between the undiminished audio signal and the output signal to enable a user to compare. A microphone is configured to capture the audio.

In another aspect, an apparatus includes a headphone driver, a microphone to capture an audio input, and a processor in communication with the headphone driver. The processor is configured to receive an audio signal from the microphone and receive spatially related user input configured to affect where a listener perceives the audio to be originating. The processor is further configured to process the audio signal according to the spatially related user input to generate an output signal. The output signal is output to the headphone driver.

In an example, the microphone is one of a plurality of microphones including a directional array. Processing the audio signal may further include sending the output signal to another headphone driver in response to user input requesting a switch of an audio output sent to left and right headphones. The spatially related user input designates a spatial area where the listener perceives the audio to be originating. Processing the audio signal causes the area from where the listener perceives the audio signal (e.g., the audio input) to be originating to shift in a direction relative to the listener selected from a list including at least one of: above, below, left, right, forward, or to the rear of the listener. A display is configured to communicate information pertaining to the output signal. The processor is configured to receive the spatially related user input from an application executing on a remote electronic device.

IV. BRIEF DESCRIPTION OF THE DRAWINGS

Figure 1:
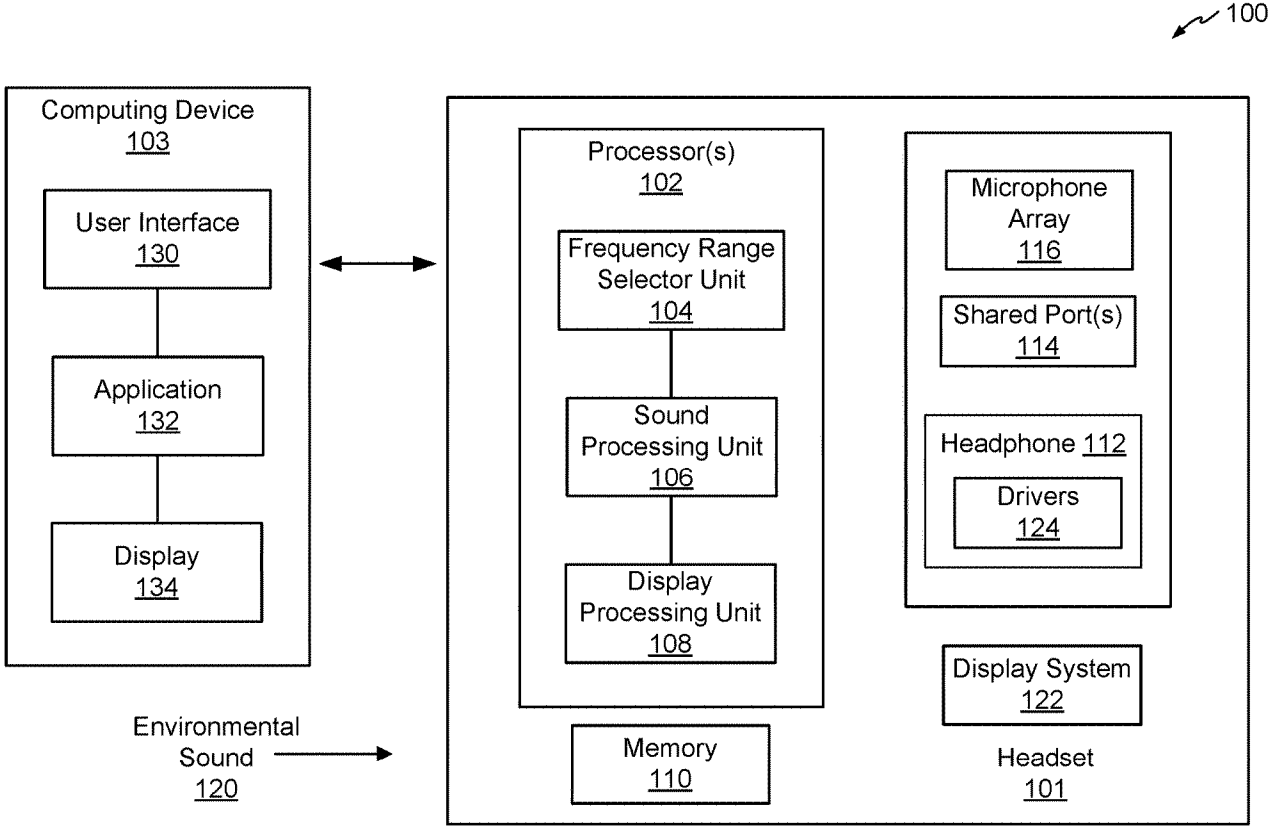
FIG. 1 is a block diagram of an illustrative implementation of a headset configured to selectively provide extraordinary hearing to promote hearing awareness, headphone technology, and sound dynamics.

Features and other benefits that characterize embodiments are set forth in the claims annexed hereto and forming a further part hereof. However, for a better understanding of the embodiments, and of the advantages and objectives attained through their use, reference should be made to the Drawings and to the accompanying descriptive matter.

V. DETAILED DESCRIPTION

A superhuman (e.g., beyond the limits of ordinary human) hearing system provides a listener with a series of entertaining and educational experiences relating to headset technology and audio effects. The experiences may include how sounds around the listener are heard, the frequency range of human hearing, hearing loss, differences of mono, stereo, or three-dimensional (3D) sound, and sound quality, among other audio related phenomena.

In one implementation, a headphone system enables users to experience extraordinary hearing to better appreciate headphone technology and audio dynamics. Headphones of an implementation include speakers and a series of microphones. In another, or the same, example, the headphones plug into or connect wirelessly to a device, such as a cellular phone running a corresponding application. A processor of the system is internal or external to the headphones and manipulates sound provided to the headphones. In one aspect, the headphones provide superhuman hearing by isolating the wearer from noise from the outside world, while still measuring the noise of the outside world. Insights are gleaned by the wearer into how hearing works.

The system also demonstrates differences between mono, stereo, and binaural sound. To further illustrate, a left channel speaker and a right channel speaker are swapped. That is, the system flips what the left and right ears of a headphone wearer hear. This feature provides an appreciation for how two ears benefit people more than one working ear, along with providing a sensation that provokes consideration of hearing dynamics and that demonstrates the effects of disorientation.

Another implementation helps a wearer understand the limits of human hearing. The headphone system may measure sounds outside of the range of human hearing (e.g., too quiet to hear) and bring them into the range of human hearing. For instance, a user in an example selects a range of hearing associated with a lion. In response to the selection, the system may sample sounds within the range of a lion's hearing and shift them into human hearing range. The shifted sounds are provided to the user so that they can hear what a lion would hear in the same surroundings.

The headphone system teaches spatial awareness relating to sound detection. For example, a perceived sound source is virtually moved to the left or to the right, or forwards or backwards. To this end, the system may use an array of directional microphones. The processor may disproportionately emphasize or raise the amplitude on audio picked up from a geographically targeted and spatially remote part of a listener's environment. The disproportionate emphasis in this example is with respect to sound spatially proximate the headphone wearer. Similarly, sound nearest the wearer (e.g., and not spatially proximate to the spatially targeted region) may seem proportionally muted. The listener perceives a 3D listening experience as their virtual zone of hearing moves spatially around their environment.

Another example includes the headphone system simulating the effects of hearing loss, teaching the wearer how fragile their hearing is. For example, the superhuman hearing headphones provide a demonstration of what happens when a listener suffers a hearing loss, such as hearing loss from loud music. A headphone wearer may select a setting to hear the after-effects of one or two loud sound occurrences. The wearer selects the setting with a user interface on the headset or a remote device in communication with the headset. The system may modify volume and frequency of audio from the microphones to enable the wearer to perceive the loss in hearing. Another example enables a listener to perceive the effects of loud noise on hearing over longer periods of time.

The system of an implementation shows what is being heard using a frequency graph. The frequency graph may be included in a pitch and loudness game. The pitch and loudness game enables a child to explore a frequency range of human hearing and a frequency range of a particular animal. The frequency range of human hearing is compared with the frequency range of the particular animal. The system maps common sounds to frequencies. In a particular example, frequencies that children can hear, but parents cannot, are identified in the pitch and loudness game. The superhuman hearing device selectively enables headphone listeners to hear sound beyond the frequency limits of human hearing.

The headphone system also includes a binaural game and a demonstration of a high compression and a lossless sound quality. The features of the headphone system additionally demonstrate the effects of the limited frequency band.

FIG. 1 depicts an illustrative implementation of a superhuman hearing enabling headphone system 100. In one example, the system 100 includes a headset and a remote computing device 103 in communication with the headset 101. A processor 102 of the headset 101 communicates with the remote computing device 103 including a smartphone, a computer, a tablet, a smart watch, or among other possible wired or wireless computing devices, as illustrative, non-limiting examples.

The processor 102 includes a frequency range selector unit 104. The frequency range selector unit 104 receives a selection based on a user input provided via a user interface 128, 130. The user input is received by the processor 102, which may be in communication with an application 132 running on the remote computing device 103. The selection corresponds to a frequency range, pitch, or volume setting. Illustrative such settings correspond to a hearing capability of a particular animal, a frequency range associated with a level of hearing loss, or a spatial position proximate a listener, among other settings.

According to a particular implementation, the frequency range of hearing of the particular setting corresponds to at least one of a range of frequency below 20 Hertz (Hz) or a range of frequency above 20 kilohertz (kHz). Where desired, a listener may select a hearing range associated with a particular animal, such as: a dog, a chicken, a goldfish, a bat, or a dolphin. This feature enables the listener to hear what the animal could hear and to compare it to what they, themselves, can hear. According to another particular implementation, the frequency range associated with the hearing loss corresponds to a particular frequency range selected between 20 Hz and 20 kHz. The particular frequency range may correspond to a range of frequencies that is inaudible to a particular age group, such as a person with poor hearing. A demonstration enables a child to hear sounds that their parents cannot. The frequency range selector unit 104 determines a selected frequency range based on the selection.

The processor 102 includes a sound processing unit 106. The sound processing unit 106 performs sound processing based on a received environmental sound and the determined selected frequency range. Environmental sound 120 is received by an externally facing microphone or microphone array 116. The microphone array 116 may be included in one or more headphones 112 having drivers 124. The microphone array 116 of an implementation is a directional microphone array, similar to an acoustic mirror. The microphone array 116 enables the listener to perceive a 3D listening experience as their virtual zone of hearing moves spatially around their environment.

The headphones 112 may include a left speaker and a right speaker. The headset 101 may include shared ports 114. The shared ports 114 enable sharing among listeners of a processed sound output from the processor 112 via daisy chaining of the shared ports 114. The sound processing unit 106 outputs the processed sound. According to a particular implementation, the processed sound corresponds to sound associated with a frequency range of hearing of a particular animal. According to another particular implementation, the processed sound may correspond to sound associated with a frequency range associated with a hearing loss. The headphones 112 are coupled with the processor 102 via wire line, wireless, or any combination thereof. A memory 110 in communication with the processor 102 stores the processed sound for later retrieval or playback.

The processor 102 includes a display processing unit 108. The display processing unit 108 initiates the display of one or more waveforms corresponding to the processed sound. The waveforms are displayed on a display 134 of the remote computing device 103, such as a cellular phone or tablet running the associated application 132 in communication with the display processing unit 108. The display 134 shows one or more waveforms associated with the processed sound output by the sound processing unit 106. The application 132 of an example provides information explaining the waveforms to the listener. According to an implementation, user input causes the processor 102 to isolate particular sounds (e.g., using the microphone array 116) to view isolated waveforms. In this manner, a user maps sounds to particular frequencies. Alternatively or additionally, a display system 122 on the headset 101 displays a waveform and other information related to the sound. The display system 122 additionally includes light emitting diodes that illuminate cups of the headphones 112 according to the processed sound or user input.

The output of the processed sound is concurrent with the display of the one or more waveforms of the processed sound. In one example, the sound processing unit 106 provides a signal to the processor 102 to play a recording demonstrating sounds heard by a person with a hearing loss on a particular frequency range as compared to sounds heard by another person not suffering from the hearing loss. The display processing unit 108 provides visual comparison of a range of frequencies heard by a person with a hearing loss as compared to a range of frequencies heard by another person not suffering from the hearing loss.

In addition to the selective audio processing features described above, such as extending/limiting human hearing and ear flipping, the system 100 includes the ability to play regular audio from a media source and to make telephone calls. Music playback is available for processing using the above disclosed techniques, as well. For example, a listener may select mono versus stereo to understand differences. Another setting enables the listener to receive binaural sound using two microphones and transmitted separately to the two ears of the listener. The system further provides insights into audio playback and ear function by enabling a user to select between high compression and lossless audio. Another selection causes audio to be played back in a limited frequency band (e.g., with no high and low frequency audio).

Figure 2:
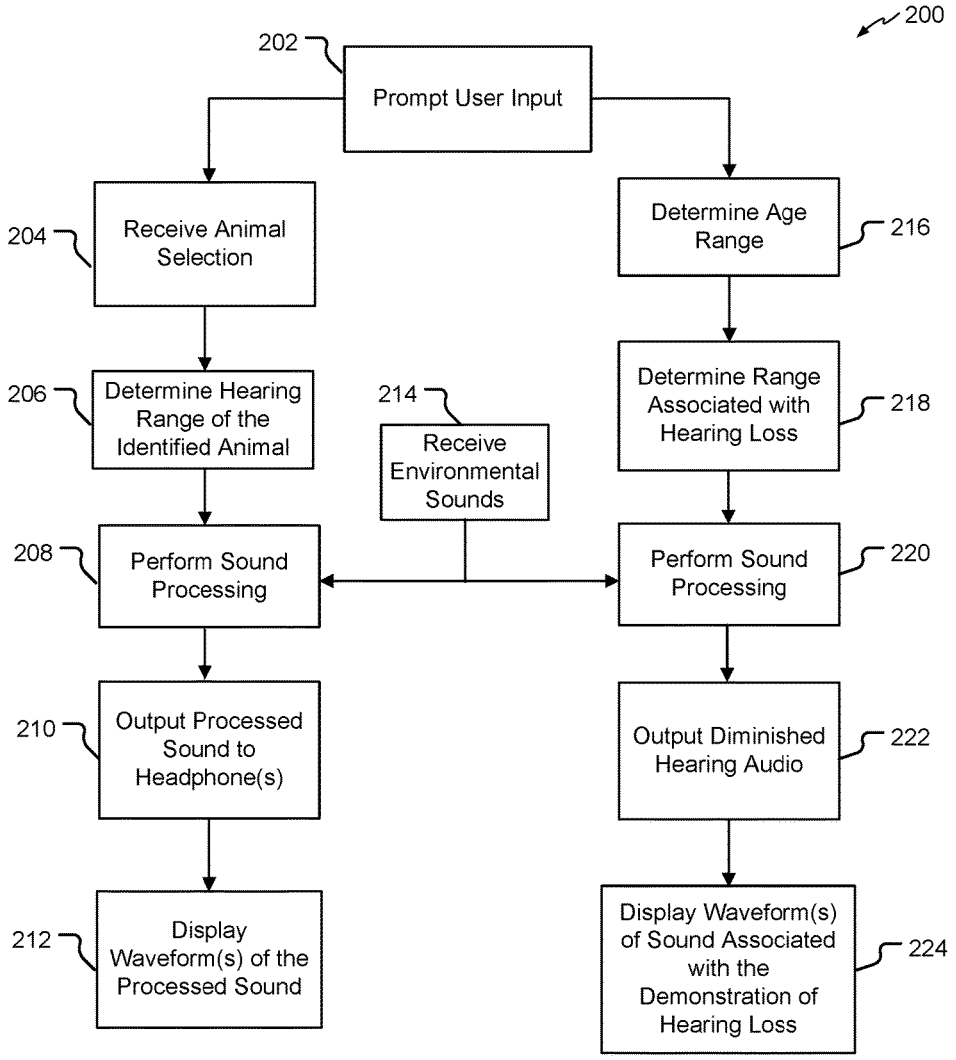
FIG. 2 is a flowchart diagram of a method of implementing operation of the headset of FIG. 1 to select and experience a level of hearing associated with an animal or a person with diminished hearing capability.

FIG. 2 depicts a flowchart of an implementation of the audio system 100 of FIG. 1. The flowchart shows a particular example where a listener selects between hearing sound processed according to an extraordinary setting (e.g., a range of hearing of an animal) and a diminished hearing setting (e.g., a human with hearing loss). Other settings enable a user to listen to spatially distant environmental noises and to swap sounds provided to left and right headphones, among others.

Turning more particularly to the flowchart, a user is prompted to make a selection using an interface 128, 130 of FIG. 1. At step 204, a particular animal is selected by the user. The animal has a range of hearing that is beyond human frequency limits. At step 206, a frequency hearing range of the particular animal is determined. For example, in FIG. 1, the frequency range selector unit 104 determines the frequency hearing range of the selected animal.

In response to the determination of the frequency hearing range of the animal, sound processing is performed at 208 to determine environmental sounds that would be heard by the animal. The environmental sounds are supplied by the microphone array 116 of the headset 101 of FIG. 1. The environmental sounds may include audible and inaudible sounds around the user. The environmental sounds are sampled and processed according to the frequency range of the animal (e.g., include frequencies beyond the limits of human hearing). For example, the sound processing unit 106 of FIG. 1 determines what environmental sounds the animal would hear and then brings those sounds into the frequency range of human hearing. A listener toggles back and forth to hear the difference between their own hearing capability and those of the selected animal.

At 210, processed sound is output to the headphone 112. For example, the sound processing unit 106 outputs the processed sound. At 212, one or more waveforms of the processed sound are displayed. For example, the display processing unit 108 of FIG. 1 outputs a frequency graph to the display unit 122 of FIG. 1. The display unit 122 displays the one or more waveforms of the processed sound on the frequency graph.

In an example where the user is interested in a demonstration of effects of a hearing loss particular to an age range, the user may make the selection using the interface 128, 130 of FIG. 1. At step 216, the age range is received from the user. The frequency range selector unit 104 of FIG. 1 determines, at 218, the frequency range associated with the hearing loss particular to the selected age range. In one implementation, the environmental sound is processed, at 220, to reflect a diminished range of hearing. A listener switches back and forth to hear the difference between their own hearing capability and the diminished one. In another example, a user listens to a recording (e.g., instead of their environment) that includes a music, conversations, a movie clip, or other recorded audio. The listener may hear the recorded audio as would one with good hearing would hear it, and may contrast that with the diminished hearing audio.

At 224, one or more waveforms associated with the sound determined at 220 are graphed and displayed. For example, the display unit 122 displays the one or more waveforms associated with the sound determined at 220.

Figure 3:
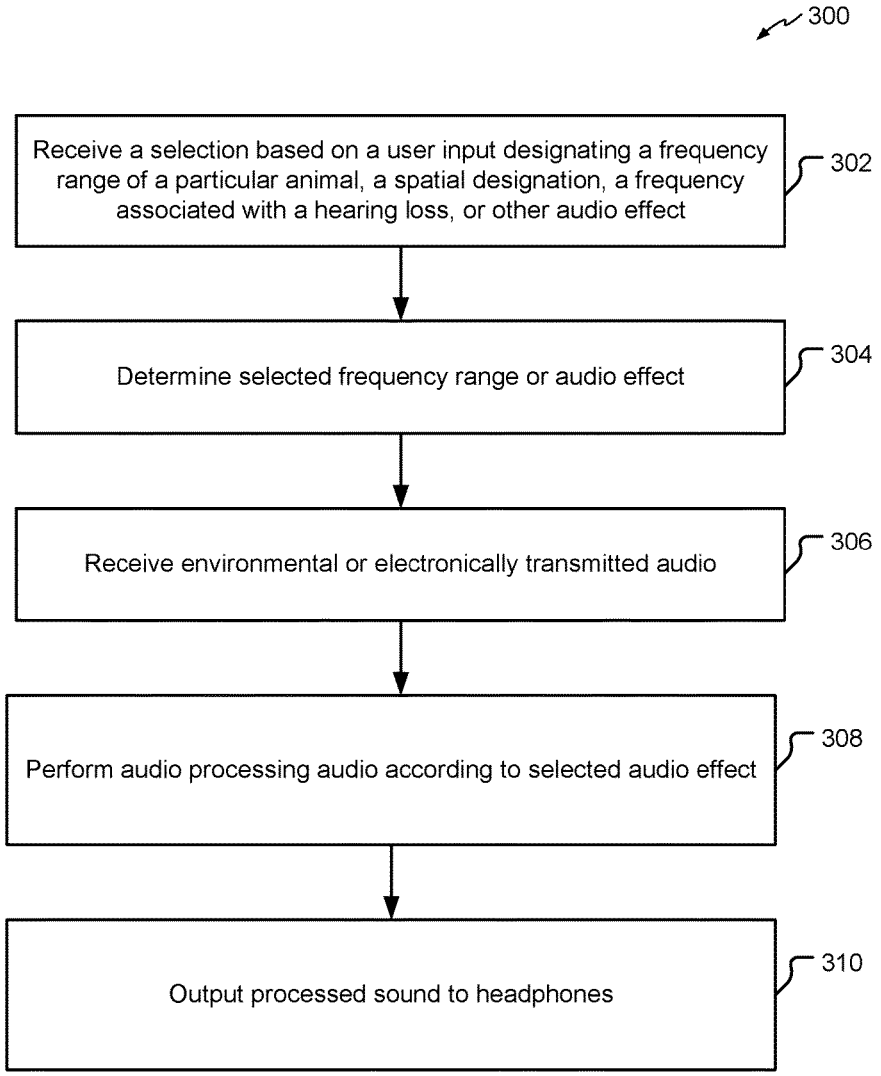
FIG. 3 is a flowchart of an illustrative implementation of a method for manipulating audio sent to the headset of FIG. 1.

FIG. 3 depicts a flowchart diagram representing an implementation of a method 300 for an extraordinary hearing headset system. The method 300 may be implemented in the processor 102 of FIG. 1. The method 300 includes, at 302, receiving a selection based on a user input. The selection in one example is associated with one of a frequency range of hearing of a particular animal or a frequency range associated with a hearing loss. In another example, the selection is meant to enable a user to selectively listen to spatially remote areas of their environment, as if they were located in the selected sector of their environment. Still another audio effect setting swaps the audio output to the left and right ears. In other example, user input selects whether a listener hears mono, stereo, or binaural. Another audio affect clips high and low frequencies as viewed on a display while the user listens.

Continuing with the example where a user has selected processing that involving frequency range adjustment, the method 300 includes determining, at 304, a selected frequency range based on the user input. The frequency range selector unit 104 of FIG. 1 determines the frequency range to apply to audio received, at 306. In one example, the processor 102 receives audio fed from an electronic device. In another instance, the processor receives audio including environmental sound picked up by the microphone array 116. The method 300 includes performing sound processing, at 308, based on the received audio and the determined selected frequency range. For instance, the sound processing unit 106 of FIG. 1 performs sound processing based on the received environmental sound and the determined selected frequency range. At 310, the processed sound is output to the headphones of the listener. As discussed herein, the output of an example includes waveform and other visual data corresponding to the audio and that is sent to a display.

According to a particular implementation, the method 300 may include displaying one or more waveforms associated with the processed sound. For example, the display processing unit 108 displays the one or more waveforms. According to another particular implementation, the method 300 may include playing a recording that demonstrates sound heard by a person with a hearing loss on a particular frequency range. For example, the processor 102 plays the recording.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media or storage device, for execution by, or to control the operation of, one or more data processing apparatus, e.g., a programmable processor, a DSP, a microcontroller, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed one or more processing devices at one site or distributed across multiple sites and interconnected by a network.

Actions associated with implementing all or part of the functions can be performed by one or more programmable processors or processing devices executing one or more computer programs to perform the functions of the processes described herein. All or part of the functions can be implemented as, special purpose logic circuitry, e.g., an FPGA and/or an ASIC (application-specific integrated circuit).

Processors suitable for the execution of a computer program include, by way of example, both general and special purpose microprocessors, and any one or more processors of any kind of digital computer. A processor may receive instructions and data from a read-only memory or a random access memory or both. Components of a computer include a processor for executing instructions and one or more memory devices for storing instructions and data.

Those skilled in the art may make numerous uses and modifications of and departures from the specific apparatus and techniques disclosed herein without departing from the inventive concepts. For example, selected implementations of a super-human hearing device in accordance with the present disclosure may include all, fewer, or different components than those described with reference to one or more of the preceding figures. The disclosed implementations should be construed as embracing each and every novel feature and novel combination of features present in or possessed by the apparatus and techniques disclosed herein and limited only by the scope of the appended claims, and equivalents thereof.

The invention claimed is:

1. An apparatus comprising:

a headphone driver; and a processor in communication with the headphone driver, the processor configured to:

receive an audio setting selection from among a plurality of audio setting selections each associated with a plurality of animals, wherein each audio setting selection is associated with a frequency range that includes at least one frequency that is within a range of hearing of an animal of the plurality of animals and is outside of a range of human hearing;

receive an audio signal;

process the audio signal according to the selected audio setting selection to generate an output signal that simulates what the animal hears by bringing sound within the range of human hearing; and output the output signal to the headphone driver.

2. The apparatus of claim 1, further comprising a microphone configured to capture an audio input and to generate the audio signal based on the audio input.

3. The apparatus of claim 1, wherein processing the audio signal includes frequency shifting a portion of the audio signal that is outside of the range of human hearing.

4. The apparatus of claim 1, wherein the processor is configured to receive user input affecting the processing of the audio signal from an application executing on a remote electronic device.

5. The apparatus of claim 1, wherein the processor is configured to initiate a display of audio related information associated with the output signal.

6. The apparatus of claim 1, wherein the audio signal is associated with at least one of environmental sound detected by a microphone or audio relayed from an electronic device having a memory.

7. The apparatus of claim 1, wherein the audio setting selection corresponds to at least one of a range of frequencies below 20 Hertz (Hz) and a range of frequencies above 20 kilohertz (kHz).

8. The apparatus of claim 1, wherein the audio setting selection corresponds to a range of hearing of a non-human species of animal.

9. The apparatus of claim 1, further comprising one or more shared ports.

10. An apparatus comprising:

a headphone driver; and a processor in communication with the headphone driver, the processor configured to:

receive user input corresponding to a frequency range associated with a level of diminished hearing associated with human hearing loss;

receive an audio signal; and process the audio signal according to the level of diminished hearing to generate an output signal; and output the output signal to the headphone driver, wherein listener wearing the headphone driver experiences a simulation of effects of the human hearing loss.

11. The apparatus of claim 10, wherein the level of diminished hearing simulates a frequency range associated with a loss of hearing attributable to aging or loud noise.

12. The apparatus of claim 10, wherein the user input is further configured to initiate sending an undiminished audio signal to the headphone driver, and wherein the user input selectively causes switching between the undiminished audio signal and the output signal to enable a user to compare sound quality between the undiminished audio signal and the output signal.

13. The apparatus of claim 10, further comprising a microphone configured to capture an audio input associated with the audio signal.

* * * * *